US007581578B2

(12) United States Patent
Coenraets

(10) Patent No.: US 7,581,578 B2
(45) Date of Patent: Sep. 1, 2009

(54) ROLLER CURTAIN DEVICE

(75) Inventor: Benoit Coenraets, Brussels (BE)

(73) Assignee: Dynaco International S.A., Moorsel (BE)

( * ) Notice: Subject to any disclaimer, the term of this patent is extended or adjusted under 35 U.S.C. 154(b) by 218 days.

(21) Appl. No.: 10/593,263

(22) PCT Filed: Mar. 3, 2005

(86) PCT No.: PCT/IB2005/050798

§ 371 (c)(1),
(2), (4) Date: Sep. 18, 2006

(87) PCT Pub. No.: WO2005/090704

PCT Pub. Date: Sep. 29, 2005

(65) Prior Publication Data

US 2008/0264582 A1 Oct. 30, 2008

(30) Foreign Application Priority Data

Mar. 17, 2004 (BE) ..... 2004/0146

(51) Int. Cl.
*A47G 5/02* (2006.01)

(52) U.S. Cl. ..... 160/267.1; 160/265

(58) Field of Classification Search ..... 160/310, 160/273.1, 264, 266, 267, 271, 265
See application file for complete search history.

(56) References Cited

U.S. PATENT DOCUMENTS

| | | | | |
|---|---|---|---|---|
| 4,976,302 | A * | 12/1990 | Taylor | 160/310 |
| 6,530,414 | B2 * | 3/2003 | Mayr et al. | 160/98 |
| 2005/0252623 | A1 * | 11/2005 | McTavish et al. | 160/310 |
| 2006/0037718 | A1 * | 2/2006 | Coenraets | 160/133 |

FOREIGN PATENT DOCUMENTS

| | | | |
|---|---|---|---|
| DE | 198 20 933 | A | 11/1999 |
| GB | 1 588 438 | A | 4/1981 |
| WO | WO 99/19590 | A | 4/1999 |

* cited by examiner

*Primary Examiner*—Blair M. Johnson
(74) *Attorney, Agent, or Firm*—Browdy and Neimark, P.L.L.C.

(57) ABSTRACT

The invention relates to a curtain device mounted on a shaft (2) about which said curtain (1) can be wound to an open position and unwound into a closed position, a drive wheel (7) fixed coaxially to said shaft (2) and cooperating with said curtain (1) such as to displace the latter between said two positions. The device comprises an oblong flexible control body (11), cooperating with the drive wheel (7), said body (11) being embodied to permit the displacement of the curtain (1) between the open position and the closed position thereof, independently of the slack formed in the curtain (1) and to be able to be displaced along at least one of the lateral edges (4) of the curtain (1) and act upon the region (8) of the latter as opposed to that arranged on the shaft (2).

15 Claims, 7 Drawing Sheets

ROLLER CURTAIN DEVICE

The invention concerns a curtain device mounted on a shaft around which this curtain may be wound toward an open position and from which it can be unwound toward a closed position, a drive wheel being secured coaxially on this shaft, preferably on both sides of the curtain, and cooperating with the latter in such a manner so as to move it between these two positions.

The known devices of this type, notably by documents U.S. Pat. No. 5,655,591, U.S. Pat. No. 5,392,836, U.S. Pat. No. 5,353,859, U.S. Pat. No. 4,690,194, DE 32 45 009, WO 99/19590 A, GB 1 588 438 A, DE 198 20 933 A and EP 1 298 264 A, require that the curtain be taut while traveling between its open position and its closed position. The consequence of this is that the construction of these devices is very complex and very costly owing to the presence of springs, guide pulleys, reduction gears, etc., which generally require very precise adjustment in order to operate correctly and which are subject to significant wear and frequent repair, especially in cases where the curtain hangs up or becomes caught.

One of the essential purposes of the present invention is to counter these drawbacks by presenting a very simple and efficient device which is economically justified and which enables numerous variants to be developed for various applications. In this manner, it is possible to design variants enabling a hermetic closure to be obtained, for example, for refrigerators, containers, silos, utility vehicles such as trucks, boats, railcars, and variants in which the curtain extends horizontally or obliquely in its closed position, etc.

For this purpose, the device according to the invention, comprises an oblong control element that is flexible in terms of its length cooperating with the drive wheel, this element being designed in such a manner to allow, on the one hand, the curtain to be moved between its open position and its closed position independently of the slack in the curtain and, on the other hand, to move it along at least one of the side edges of the curtain and act on the zone of the latter opposite that directed from the side of the aforementioned shaft equally independently of possible slack in the curtain.

The control element and its arrangement in the device according to the invention are thus such to allow slack to form in the curtain when it is being moved, without this hampering its operation.

This is not possible with the devices according to prior art in which, on the contrary, all measures are taken to avoid slack. The complex construction of these known devices is the result of this requirement.

Advantageously, the pitch diameter of the drive wheel is, on the one hand, less than the diameter of the wound portion of the curtain in its open position and, on the other hand, greater than the diameter of the aforementioned shaft or the would portion of the curtain in its closed position.

Within the scope of the present invention the expression 'pitch diameter' means the distance traveled by the control element from the drive wheel over a complete a revolution of the latter divided by $\pi$.

Other details and features of the present invention will become more apparent from the following description of a few types of specific embodiments, although not comprehensive, when taken in conjunction with the accompanying drawings.

Figure 11:
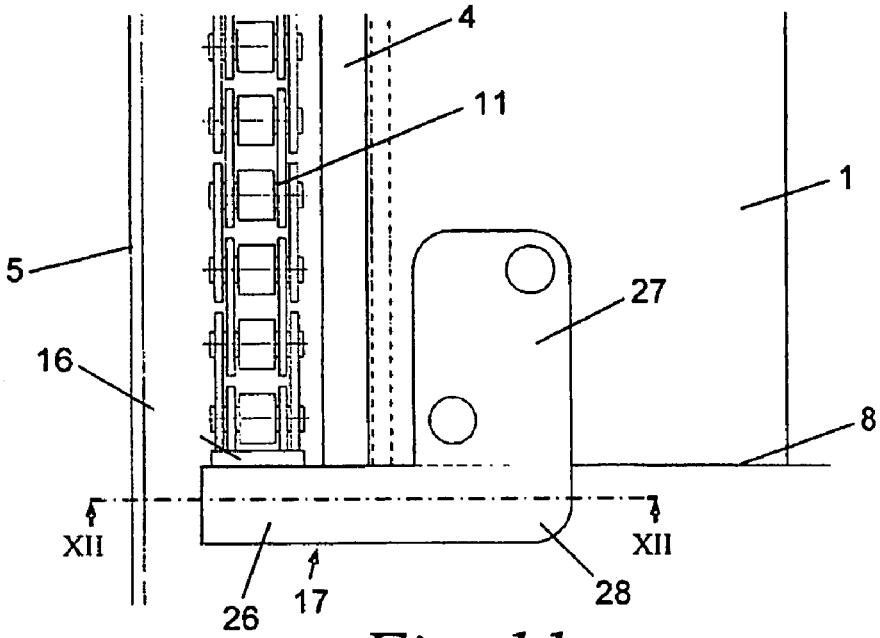

FIG. 11, drawn to a larger scale, is a detailed representation of the front of the lower part of the curtain showing one of its side edges of this second embodiment.

Figure 12:
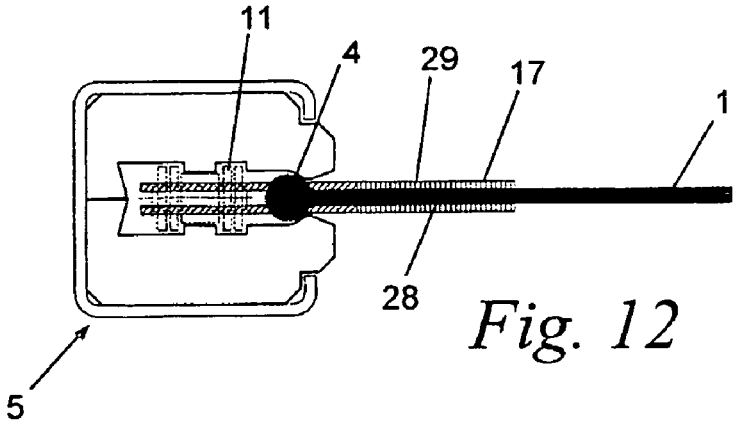

FIG. 12 is a cross section along line XII-XII in FIG. 11.

Figure 9:
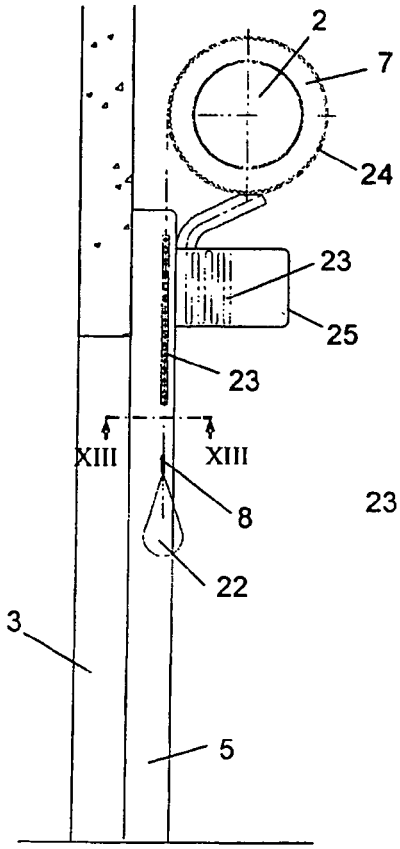
FIG. 9 is a side view essentially identical to that of FIG. 8 when the curtain is moving toward the closed position.
Figure 13:
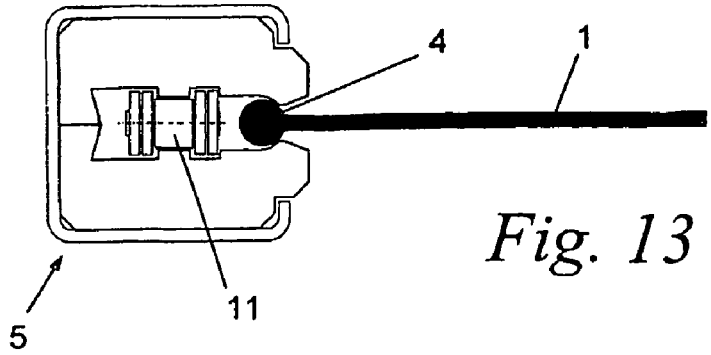

FIG. 13 is a cross section along line XIII-XIII in FIG. 9.

Figure 14:
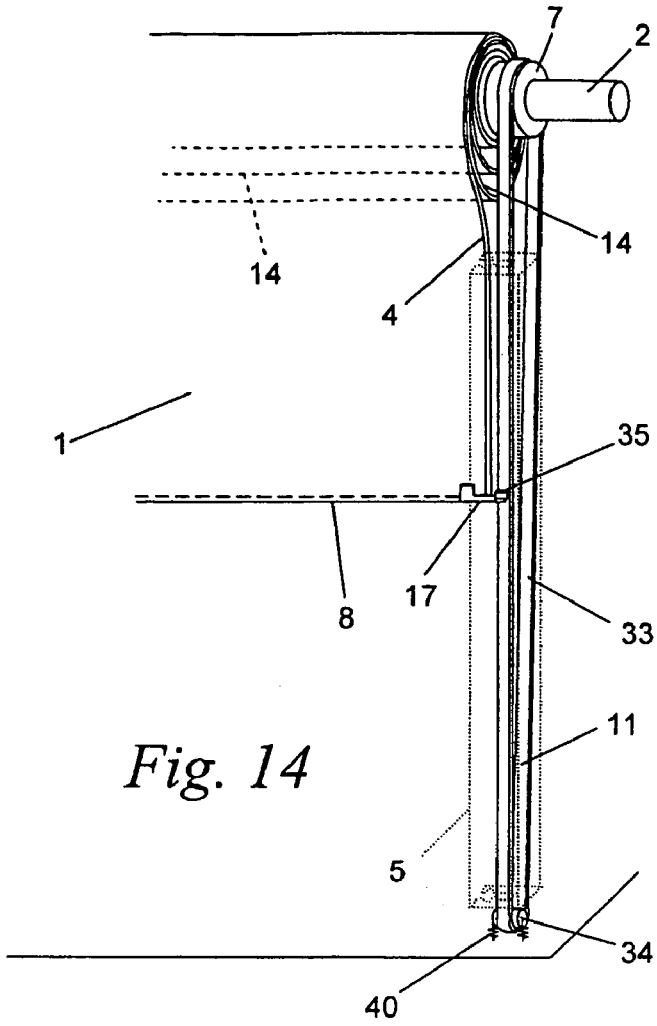

FIG. 14 is a diagrammatic view in perspective of part of a curtain device according to a third embodiment of the invention.

Figure 15:
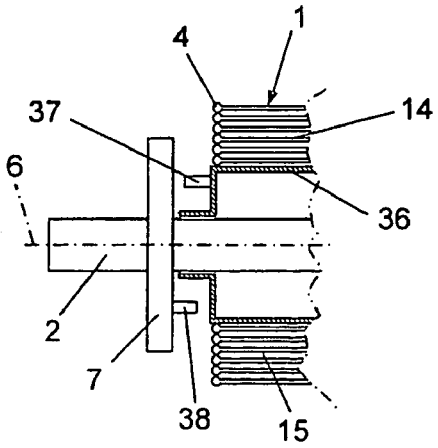

FIG. 15 is a cross section of a portion of a device according to a fourth embodiment of the invention.

Figure 16:
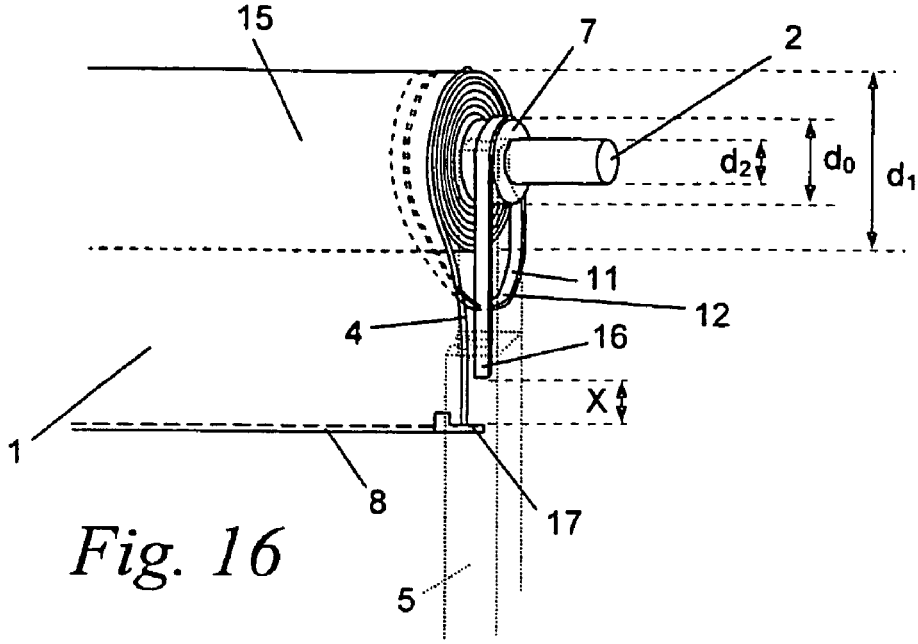

FIG. 16 is a diagrammatic view in perspective of a fifth embodiment.

Figure 17:
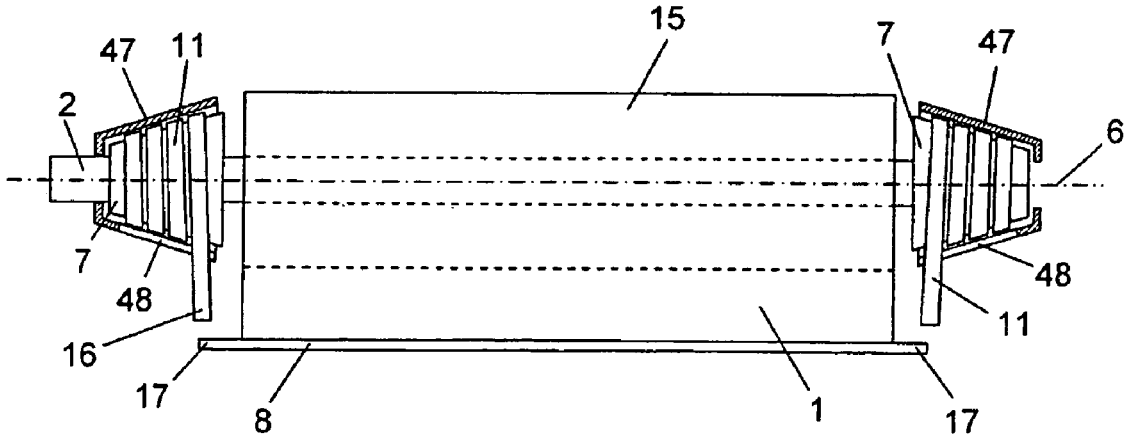

FIG. 17 is a diagrammatic front view of a sixth embodiment.

Figure 18:
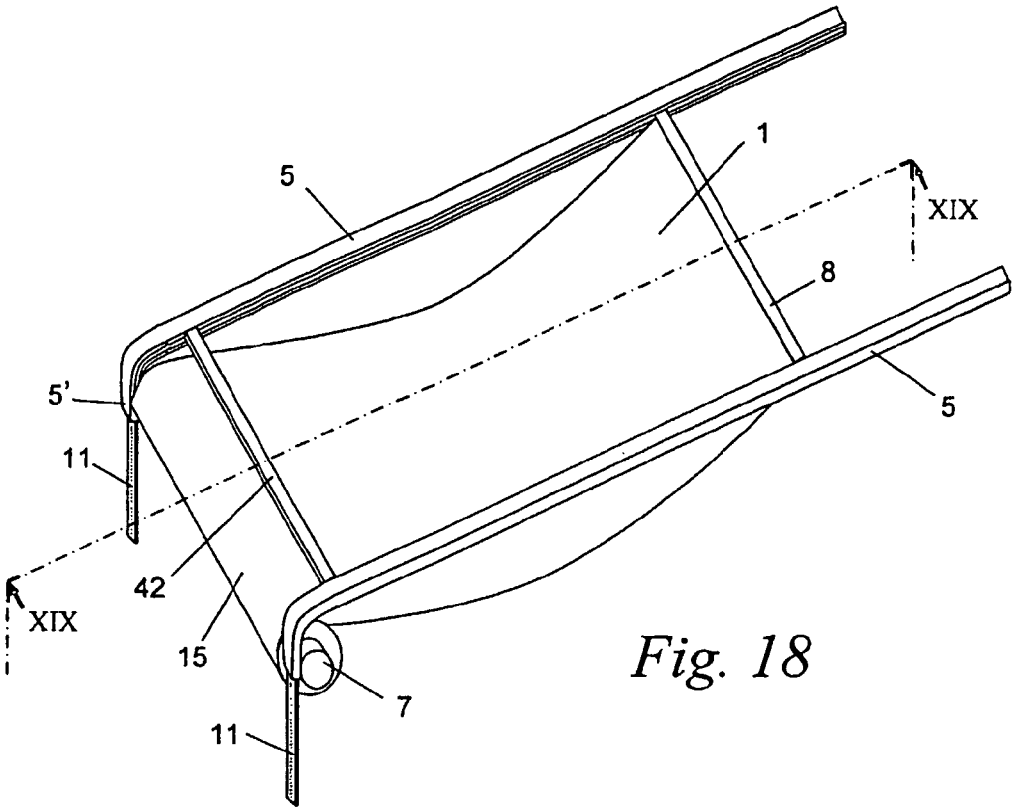

FIG. 18 is a diagrammatic view in perspective of a seventh embodiment with the curtain in an intermediary position.

Figure 19:
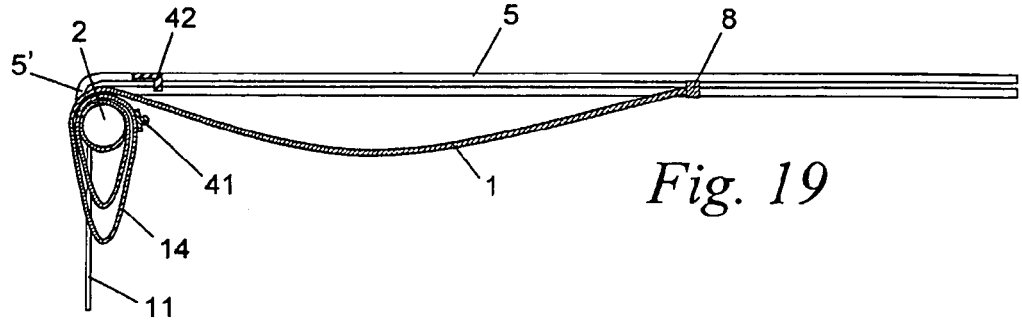

FIG. 19 is a diagrammatic longitudinal cross section along line XIX-XIX in FIG. 18.

Figure 20:
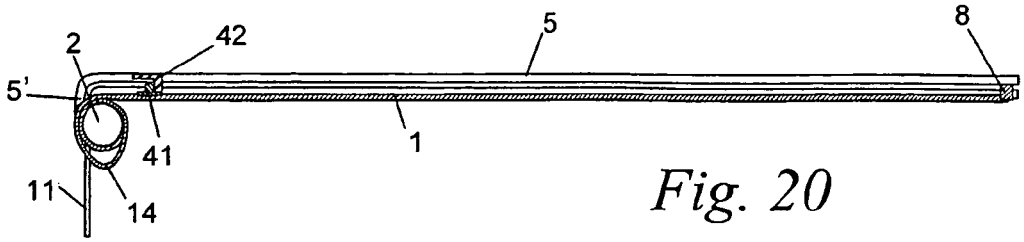

FIG. 20 is a view essentially identical to that of FIG. 19 with the curtain in the closed position.

Figure 21:
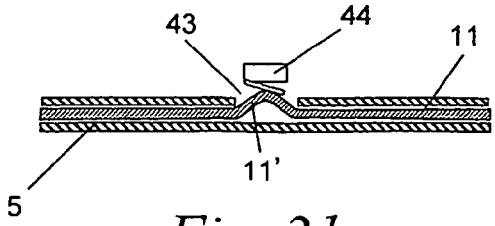

FIG. 21 concerns a variant of the seventh embodiment and, depicted to a larger scale, is a longitudinal section of part of a guide rail in which a control element moves.

Generally speaking, the present invention is relative to a windable curtain device cooperating with drive means allowing the curtain to move between an open position and a closed position. It should be noted that the curtain can be wound around a shaft which is integral with that of the drive means. The curtain is generally intended to close an opening in a wall or any other opening, covering a swimming pool, an area such as a veranda, or used for creating a screen, for example in front of a window, etc. Of course, this list is not comprehensive.

Within the scope of the present invention, the term "curtain" refers to all panel or plane surface made of a material that is at least partially pliant, flexible, semi-rigid, or with one or more stiffeners, such as a tarpaulin, a plastic strip, a canvas or metal sheeting, mesh, etc., which can be wound around a shaft.

It should be noted, however, that marked preference is given to pliant flexible curtains formed, for example, by a tarp, so that the description given below shall be limited to a device in which the curtain is formed by a tarpaulin.

Figure 1:
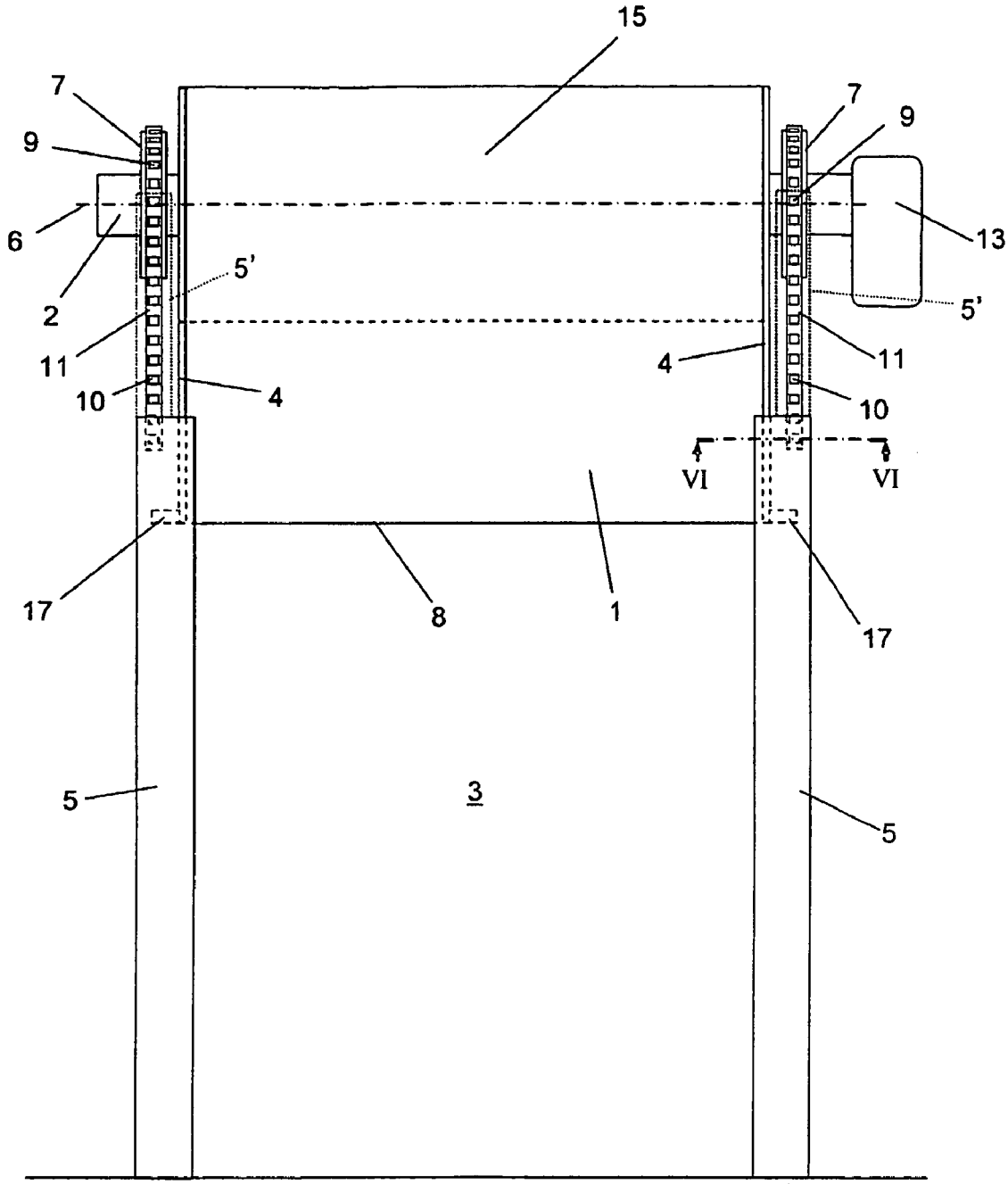
FIG. 1 is a diagrammatic front view of a first embodiment of a curtain device according to the invention.
Figure 2:
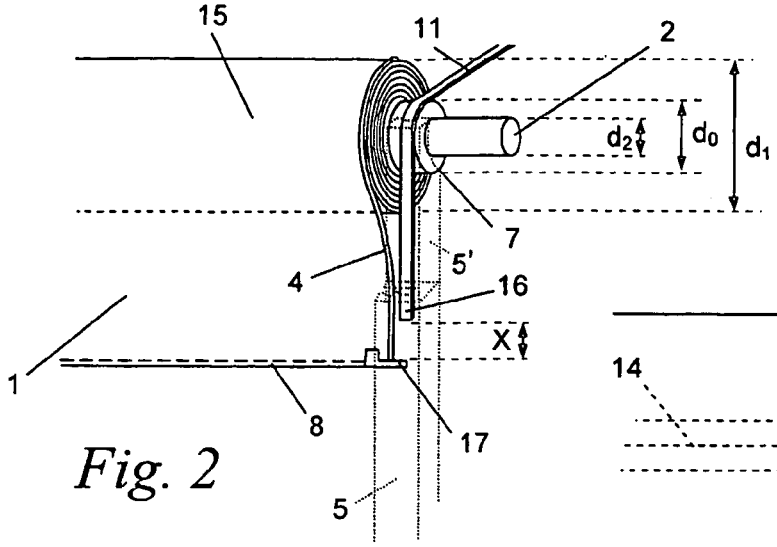
FIG. 2 is a diagrammatic view in perspective of a part of the curtain device of this first embodiment when the curtain is in the open position.
Figure 5:
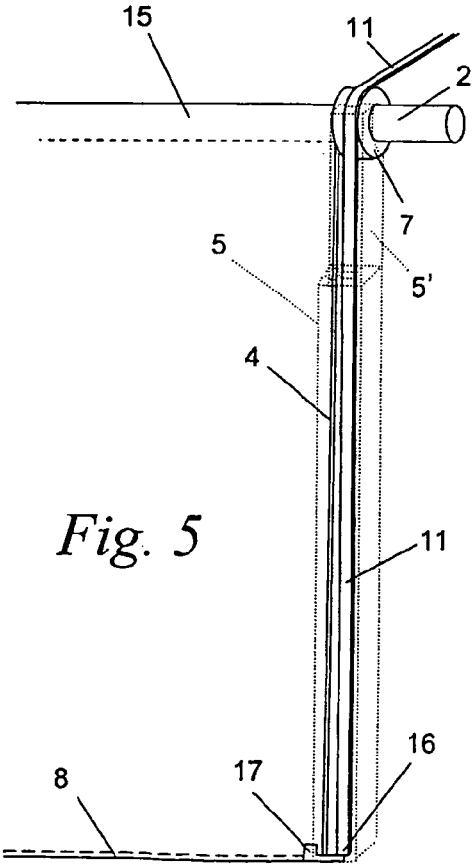
FIG. 5 is a view substantially identical to that of FIG. 4 when the curtain is in its closed position.

A first embodiment of a curtain device is represented in FIGS. 1 to 6. This device includes a curtain 1, winding and unwinding vertically, that is secured with its upper edge to a shaft 2 above an opening 3 and extending substantially over the entire Width of the latter. The curtain 1 may be moved between an open position, as shown in FIGS. 1 and 2, and a closed position, as shown in FIG. 5. In the open position, the curtain 1 is almost entirely wound around the shaft 2 and forms a roll 15, while in the closed position, the curtain 1 is practically completely unwound from this shaft 2. In certain cases, the curtain 1 can be wound entirely around the shaft 2, in such a manner to maintain a maximum amount of free space below the curtain in its open position.

When the curtain 1 moves toward its open or closed position, the side edges 4 of the curtain 1, which feature an edge roll protruding in relation to the plane of the curtain, are guided in the guide rails 5 mounted on either side of the opening 3 on essentially the entire height of the latter.

Both sides of the curtain 1 are equipped with a drive wheel 7, forming part of the aforementioned drive means, which is secured coaxially on said shaft 2, such that said shaft 2 and this drive wheel 7 move at the same angular speed. Each of these drive wheels 7 cooperates with a control element 11 enabling the curtain 1 to move toward its closed position and which, according to the invention, is mounted freely in relation to the curtain 1, notably in relation to the latter's free edge 8 on which it may apply a pushing force.

The drive wheel 7, in particular, consists of a toothed wheel, while the control element 11 is formed by a narrow and flexible oblong strip, but incompressible in terms of its length, such as a strap. This strip is provided with a series of holes 10 which are evenly spaced along its longitudinal direction and which mesh with the teeth 9 on the drive wheels 7 at a constant distance in relation to one another around the periphery of a circle, the center of which is located at the axis 6 of the drive wheels 7. In FIGS. 2 to 5, these teeth and holes are not represented for clarity purposes.

The diameter $d_0$ of the drive wheels 7, particularly the pitch diameter of these wheels, is less than the diameter $d_1$ of the roll 15 when the curtain 1 is in its open position and greater than the diameter $d_2$ of the shaft 2 or the portion of the curtain 1 still wound in the closed position. Diameter $d_2$ is normally slightly greater than the diameter of the shaft 2 owing to the fact that, in the closed position, a small portion of the curtain 1 generally remains wound on the shaft 2.

Preferably, the diameter $d_0$ is equal to or greater than half the sum of the diameters $d_1$ and $d_2$.

In the open position, the curtain 1 is practically entirely wound around the shaft 2 and forms successive coils 14, as shown in FIG. 2. In this position, each end of the lower edge 8 of the curtain 1, opposite that mounted on the shaft 2, is held in the guide rails 5.

The control elements 11, the lower end 16 of which is, in the open position, held in the upper part of the guide rails 5, are also guided in the respective guide rails 5 when the curtain 1 is opened and closed, as will be described in greater detail in relation with FIG. 6.

In the curtain's 1 open position, as shown in FIG. 2, its lower edge 8 is at a distance X below the free end 16 of the corresponding control element 11. This distance allows a certain tolerance in the construction and adjustment of the device according to the invention. The dimensions of the drive wheel and the control element can be calculated according to the curtain's displacement in such a manner to reduce this distance to zero.

When one wants to move the curtain 1 from its closed position from its open position, the shaft 2 is driven by an electric motor 13. As a result, the roll 15, formed by the coils 14 of the curtain 1, and the drive wheels 7, which are secured on the shaft 2, are subjected to the same movement of rotation. The curtain 1, which is held by its side edges 4 in the guide rails 5, is braked and, in certain cases, even blocked in its movement toward its closed position by friction which inevitably exists between its edges 4 and the guide rails 5. This results in that, when starting to close the curtain, the coils 14 of the roll gradually enlarge and detach from one another forming slack, as diagrammatically represented in FIG. 3. At the same time, the control elements 11 move in the glide rails 5.

Figure 3:
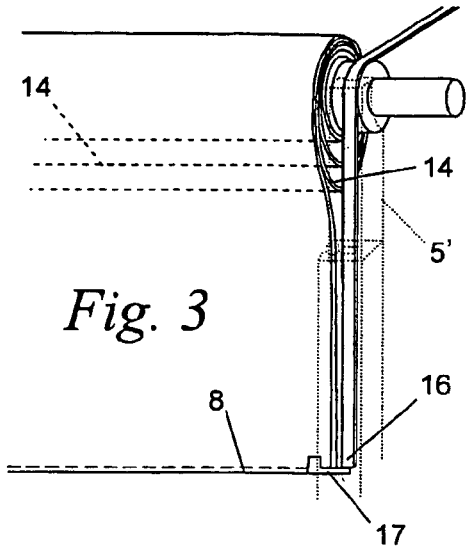
FIG. 3 is a view substantially identical to that of FIG. 2 when the curtain is moving toward its closed position.
Figure 4:
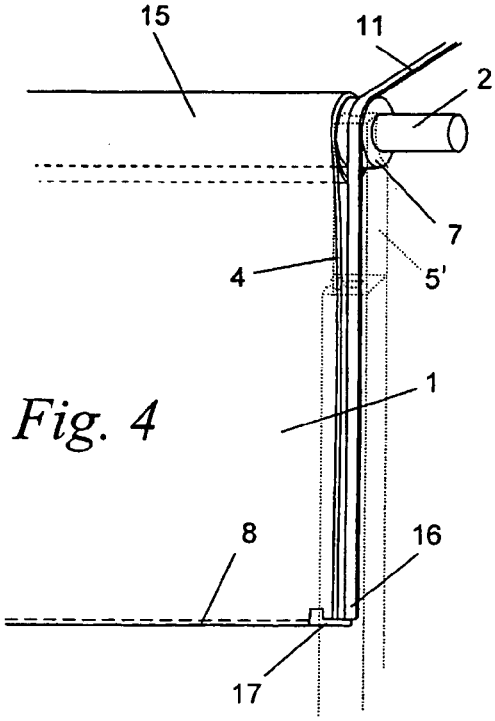
FIG. 4 is a view substantially identical to that of FIG. 3 when the curtain is moving toward its closed position and when the diameter of the wound portion of the curtain substantially corresponds to the pitch diameter of the drive wheel.

As mentioned above, inasmuch as the movement of the curtain 1 is hindered by said friction between the guide rails 5 and the side edges 4 of the curtain 1, the end 16 of the control elements 11 gradually approaches the lower edge 8 of the curtain 1. When this lower end 16 is at the height of the lower edge 8 of the curtain, this end 16 rests on a pin 17 provided on this lower edge 8, as shown in FIG. 3.

At this time, the control elements 11, driven by the drive wheels 7, exert a pushing force on the lower edge 8 of the curtain 1, such that the side edges 4 of the curtain 1 move in the guide rails 5 along their longitudinal direction at the same speed as the control element 11.

As soon as the diameter of the roll 15, formed by the wound portion of the curtain 1, becomes less than the pitch diameter $d_0$ of the drive wheel 7, the traveling speed of the control elements 11 becomes greater than the circumferential traveling speed of the roll 15. In this manner, the slack formed disappears as the curtain approaches its closed position, as shown in FIG. 5.

When the curtain 1 is in its closed position, it is nearly completely unrolled from the shaft 2. However, as already mentioned above, it is possible that the length of the curtain 1 is greater than the height of the opening 3 in order to compensate adjustment tolerances, for example, which may be present, such that, as in this case, a small part of the curtain may remain wound on the shaft 2.

When the curtain is opened once again, the shaft 2 is actuated by the electric motor 13 in the direction opposite that which closes the curtain 1. In this manner, the coils 14 of the curtain 1, which may have possibly remained on the shaft, are initially taut around the latter and then the remainder of the curtain 1 is wound normally around the shaft 2.

Simultaneously, the control elements 11, which are mounted freely in relation to the curtain 1, are moved in the guide rails 5 by the action of the drive wheels 7. Given that the pitch diameter $d_0$ of these drive wheels 7 is initially greater in diameter than the diameter of the wound portion of the curtain 1, the lower end 16 of the control element 11 gradually moves away from the lower edge 8 of the curtain 1. Then, when the diameter of the wound portion of the curtain 1 becomes greater than the pitch diameter of the drive wheels 7, the contrary occurs, and the curtain 1 travels at a greater speed in relation to that of the control elements 11.

When the curtain 1 is in its open position, as shown in FIGS. 1 and 2, the distance between the lower end 16 of the control elements 11 and the lower edge 8 of the curtain 1 is again more or less equal to the distance X or zero.

The part of the control element 11 that, in its open position, is located beyond the drive wheels 7 in relation to its lower end 16, may be collected in an enclosure not shown in the figures.

Figure 6:
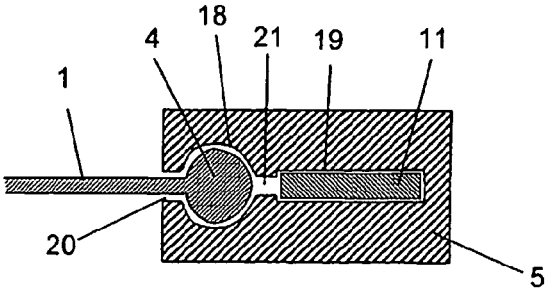
FIG. 6 is a cross section, along line VI-VI of FIG. 1, of a guide rail in which the control element and the side edge of the curtain are guided.

A cross section of the guide rails 5 is diagrammatically represented in FIG. 6. These guide rails 5 feature two parallel channels 18 and 19 that extend their entire length.

The first channel 18, featuring a groove 20 directed toward the opening 3, houses the side edge 4 of the curtain 1. The portion of the latter adjacent to this side edge 4 extends through the groove 20. In this manner, the curtain 1 can be moved along the longitudinal direction of the guide rails while each of the side edges 4 is guided in said first channel 18.

The second channel 19 serves as a guide track for the control element 11 along the side edge 4 of the curtain.

In order for the lower end 16 of this control element 11 to be able to press on the pin 17 of the lower edge 8 of the curtain 1, a passageway 21 is provided between said channels 18 and 19 extending over essentially the entire length of the latter in order to allow the pin 17 to penetrate in the second channel 19 and to cooperate in this manner with the control element 11.

The fact that the pin 17 extends though said passageway 21 into the channel 19 results in that part of this pin is located below the lower end 16 of the control element 11.

The dimensions of said second channel 19 substantially correspond to the dimensions of the control element 11, such that the latter cannot curve or bend in this channel 19. In this manner, the control element 11, which is essentially incompressible in terms of its longitudinal direction, can exert a pushing force on the pin 17 provided on the lower edge 8 of the curtain 1 by means of the drive wheel 7 and thus drive the curtain 1 toward its closed position.

The part of the guide rails 5 defining the channel 19 is, advantageously, extended beyond the level of the axis 6 of the shaft 2, opposite the drive wheel 7 so as to guide the control element 11 as much as possible. This extension is designated by reference 5' in the figures.

The control element 11 consists, for example, of a strip or lance made of p-phenyleneterephtalamide, known under the brand name "Kevlar", coated with tetrafluoroethylene, known under the brand name "Teflon", measuring 2 mm thick and 20 mm wide. This strip has a series of holes 10 that cooperate with the teeth 9 on the drive wheel 7, as already described above.

In the embodiment, according to the invention, represented in FIGS. 1 to 6, the strip, which forms the control element 11, extends in the guide rail 5 substantially in the same plane as the curtain 1, as shown in FIG. 6. The width of the passageway 21, which terminates in the channel 19, in which the control element 11 is housed, is thinner than the latter such that this element cannot enter the passageway 21.

Figure 7:
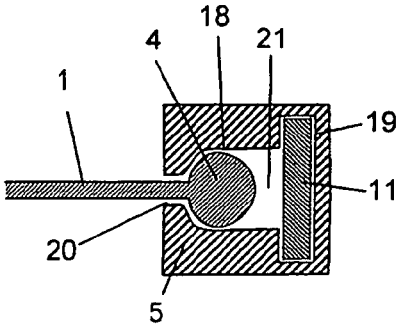
FIG. 7 is a cross section similar to that of FIG. 6, in which the control element has undergone a 90° twist before entering the guide rail.
Figure 10:
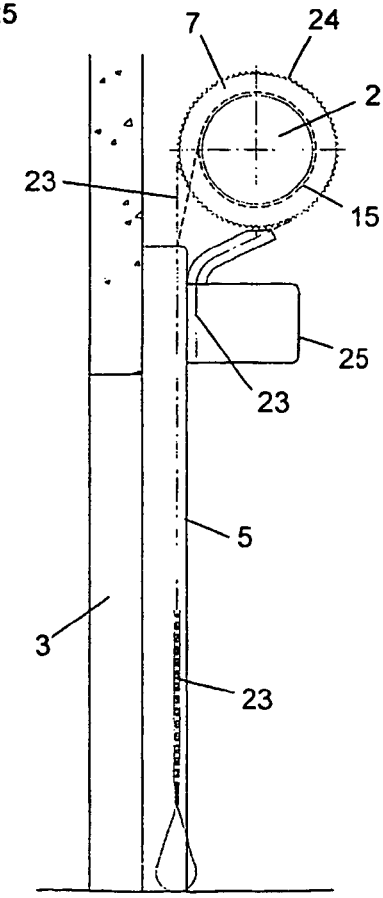
FIG. 10 is a side view essentially identical to that of FIG. 8 when the curtain is in the closed position.

Given that, in the embodiment according to FIGS. 1 to 6, the control element 11 is formed by a narrow flexible strip having a rectangular cross section, it is also possible to foresee that the channel 19 of rectangular cross section extends with its large side in a direction perpendicular in relation to the plane of the curtain 1. In such a case, the control element undergone a 90% twist in the space between the drive wheel 7 and the guide rail 5. In this manner, the width of the passageway 21 may be greater than the thickness of the control element 11, but less than the latter's width, as shown in FIG. 7.

A second embodiment of the curtain device, according to the invention, is represented in FIGS. 8 to 13, which differs in relation to the first embodiment described above in that the control element is formed by a chain 11 meshing with a conventional toothed wheel 7 and that ballasting 22 is provided at the lower edge 8 of the curtain 1 opposite the edge of the latter which is secured to the shaft 2. The chain 11 is formed by a series of links articulated between one another around parallel axes, such as a bicycle chain, for example.

The pitch diameter $d_0$ of the toothed wheel is less than the diameter $d_1$ of the roll 15, which is formed when the curtain 1 is in its open position, is greater than the diameter $d_2$ of the portion still wound 15 of the curtain 1 when the latter is in the closed position.

Figure 8:
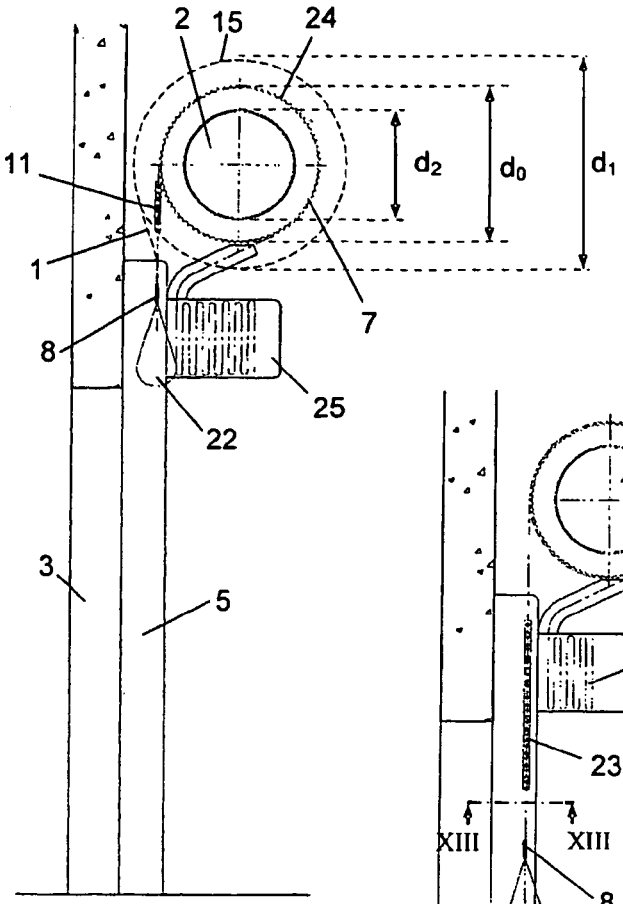
FIG. 8 is a side view of a second embodiment of the device according to the invention in the open position.

When the curtain 1 is being closed, by the rotation of the shaft 2, from the open position, as shown in FIG. 8, the curtain 1 unwinds from this shaft 2 without slack forming owing to the action of the weight provided by the ballasting 22.

The chain 11 also moves in the guide rail 5 as a result of the action of the toothed wheel 7. The toothed wheel 7 is secured coaxially on the shaft 2. This chain 11, which does not form a loop, is dispensed from a bin 25 installed below the shaft 2.

As mentioned above, when the curtain 1 moves toward its closed position, slack does not normally form around the shaft 2 owing to the traction action exerted by the ballasting 22 on the curtain 1.

However, when the side edges 4 of the curtain 1 are braked in the guide rails 5 due to action by the wind, which could exert a pushing force on the plane of the curtain 1 while the latter is being closed, curtain 1 movement stops or is shut down. At this time, slack forms around the shaft 2 and the lower end 16 of the chain 11, which continues to move in the guide rail 5, approaches the lower edge 8 of the curtain 1 and drives it. This is, of course, also the case for the first embodiment described above.

Detail of the chain 11 and the pin 17 at the lower edge 8 of the curtain 1 is represented in FIG. 11. This pin 17 forms part of an L-shaped part 26, the arm of which forms the pin 17 and extends parallel with the lower edge 8 of the curtain 1 in the corresponding guide rail 5, the other arm 27 extending parallel to the corresponding side edge 4 of the curtain 1. The part 26, in particular, consists of two symmetrical metal plates 28 and 29 which are mounted on either side of the curtain plane 1, such that the latter is clamped between these two plates 28 and 29.

The guide rail 5 features a profile such as to guide the chain 11 along its longitudinal direction without it being able to disengage laterally in relation to this direction. The side edge 4 of the curtain is held in the guide rail 5 between the opening 3 and the location where the chain 11 is guided, exactly as in the first embodiment.

When a force above a certain value is exerted on the curtain 1 transversally to the plane of the latter, for example by a vehicle running into the curtain 1, the latter's side edges 4 disengage from the guide rails 5. For this purpose, the side edges 4 of the curtain 1 or the guide rails 5 can be designed to deform elastically. Given that the chain 11 is not secured to the curtain 1, the pin 17 easily disengages from the chain 11.

FIG. 14 represents a third embodiment of the curtain device, according to the invention. it differs essentially from the previous two embodiments described in that the control element is formed by a looped belt 33. This belt 33 is guided and driven by the drive wheels 7 mounted on the shaft 2. These drive wheels can, in this case, be replaced by pulleys.

In the lower part of the opening 3, this belt 33 cooperates with a roller 34, which is preferably resiliently mounted in relation to the floor by means of coil springs 40 for example, in order to maintain it constantly taut.

A contact element 35, formed by a boss or hook for example, is mounted on the belt 33 between this lower edge 8 and the shaft 2.

When the curtain 1 moves under the rotation of the shaft 2, the successive coils 14 of the roll 15 become larger and form slack as in the first embodiment. Simultaneously, the belt 33 is moved following the action of the drive wheel 7 and the contact element 35 approaches the lower edge 8. When the contact element 35 touches the pin 17 of the lower edge 8, it exerts a force on this lower edge 8 in order to move the curtain 1 toward its closed position. As this contact element 35 moves, the coils of the curtain 1 unwind and the slack diminishes. In fact, this contact element 35 fulfils the same role as the control element's free end 16 of the first and second embodiment.

When the curtain is reopened from its closed position, the shaft 2 turns in the direction opposite that of closure, such that the curtain is wound without slack onto the shaft 2. Given that the diameter of the drive wheel 7 is, at this time, greater than the wound portion of the curtain 1, the contact element 35 moves away from the lower edge 8 of the curtain until these diameters are substantially equal. While the remaining portion of the curtain 1 is being wound, its lower edge 8 gradually comes to within a short distance from the contact element 35, at the moment when the curtain is in the open position.

FIG. 15 concerns a fourth embodiment which is characterized in relation to the previous embodiments described in that the curtain 1 is wound around a drum 36 which is coaxial with the shaft 2 and which is mounted freely on the latter. The side face of this drum 36, directed toward the drive wheel 7, is equipped with a stop 37 which cooperates with a stop 38 located on the drive wheel 7 side opposite the drum 36. Both stops 37 and 38 are mounted at the same distance from the axis 6 of the shaft 2.

Initially, when the shaft 2 and the drive wheel 7 begin to rotate in order to move the curtain 1 toward its closed position, the control elements, not represented in FIG. 15, move toward the edge of the curtain 1 opposite that mounted on the drum 36 while the latter remains more or less immobile. At the moment when these elements act on this edge, the curtain 1 unwinds at the same linear speed as the control element. The consequence of this is that the drum 36 rotates at an angular speed less than that of the drive wheel 7 given that the diameter of the wound portion of the curtain is greater than the diameter of the drive wheel 7.

As soon as the diameter of the wound portion of the curtain 1 has become more or less equal to the diameter of the drive wheel 7, the drum turns at the same angular speed as the drive wheel. As the diameter of the wound portion of the curtain 1 decreases in relation to the diameter of the drive wheel 7, the rotation speed of the drum 36 increases in relation to that of the drive wheel 7 up to the curtain's closed position. The device can be dimensioned so that the stop 37 comes into contact with the stop 38 when the curtain reaches its closed position. It is, however, possible to plan that even in the closed position, these stops 37 and 38 do not touch.

In this embodiment, the device's dimensions are selected such that no slack forms in the curtain 1 while it is being closed. During this closing operation, the drum 36 only turns around its axis 6 by the action of the lower end of the control elements 11 on the pins provided for this purpose at the edge of the curtain 1 opposite the one on the shaft 2 side. There is no contact between stops 37 and 38 while the curtain 1 is moving toward the closed position.

When the curtain 1 opens from its closed position by the rotation of the shaft 2 in the opposite direction in relation to that during closure, the stop 38 of the drive wheel 7 presses against the stop 37 of the drum 36 such that the latter is actuated by the drive wheel 7 and that the curtain 1 is wound around the drum 36. Given that when the curtain 1 begins to open, the diameter of the wound portion of the curtain 1 is less than the diameter of drive wheel 7, the control element 11 is raised faster than the curtain 1.

It is clear that when the opening to be closed by the curtain is very high, slack may form when the curtain is closed when the stops 37 and 38 touch during the closing operation. In this case, this slack is less significant in relation to the other embodiments described above.

The drum assembly 36 and stops 37 and 38 form a compensator designed to reduce or avoid the formation of slack during curtain travel. The construction of this compensator is very simple and does not require springs, for example.

In an embodiment of the curtain device where a compensator is provided, it is also possible to secure the lower end of the control element, or the contact element 35, to the pin 17 in a removable manner. In this manner, the edge of the curtain 1 opposite the one oriented toward shaft 2 is connected to the control elements throughout the entire closing and opening cycle and until the side edges 4 of the curtain 1 disengage from the guide rails, for example, by a vehicle running into the curtain 1. In such a case, the lower end 16 of the control element, or the contact element 35, is automatically separated from the pin 17.

In addition, the free end 16 of the lance which is to cooperate with the curtain is preferably beveled as is the pin 17, in such a manner as to facilitate the disengagement of the side edge 5 of the curtain 1 from the guide rails due to an encounter with an obstacle, as indicated above.

In the second embodiment, a beveled end-piece can be placed at the free end of the chain 11, in the same manner as the end of the lance.

FIG. 16 is relative to a fifth embodiment which is characterized in relation to the first embodiment represented in FIG. 2, by the fact that the end of the strip 11, which forms the control element, is secured by its opposite end to that is acting on the curtain 1 on the shaft 2 and that this strip 11 is wound or unwound between the coils 14 of the roll 15 of the curtain 1. This avoids having to use a bin, as in the second embodiment, to house the part of the control element, formed by a strap or a lance, beyond the drive wheel.

In order to be able to compensate the difference in diameter between the wound portion of the curtain 1 and the drive wheel 7, the strip 11 is provided sufficient length to allow the outer coil 12 of the wound portion of this strip 11 to be able to form a loop in the same manner as slack around the shaft 2.

FIG. 17 concerns an embodiment that differs from the previous embodiments described in that the control element formed by an incompressible strap 11, is wound in a spiral manner on a truncated conical drive wheel 7, toothed or otherwise, the form of which is such that, during either unwinding or winding, the linear travel speed of the strap corresponds to that of the curtain 1 between its open position and closed position.

When this wheel 7 is not toothed, grooves, not represented, are preferably provided in the outer surface of the wheel, which extend spirally around the axis 6 and in which the control element moves 11. A housing 47 is provided around the drive wheel 7 which features a slot 48 in its lower part, which extends in the plane passing through the axis 6 of the shaft 2 and parallel to the direction of travel of the curtain 1 between its open position and its closed position through which the control element 11 can be wound onto or unwound from the drive wheel 7.

In other cases, for example for covering swimming pools, verandas, etc., if, on the contrary, to prevent the side edges of the curtain from exiting the guide rails, the rails are made of a rigid material or rendered rigid. Furthermore, the pins are secured to the edge of the curtain opposite that of the side of the shaft on which the curtain is mounted and are held in a sliding manner in the guide rails. This is thus possible only for embodiments where the control element is constantly in contact with the pin during curtain travel.

FIGS. 18 to 20 show an embodiment in which the curtain travels horizontally between an open position and a closed position. The edge 8 of the curtain 1 opposite that of the shaft 2 side is formed by a rigid bar, the ends of which form the pins which slide in the guide rails 5, such that the pins cannot disengage from the latter.

In order to tighten the curtain 1 in its closed position, added thickness 41, preferably rigid, extends along the entire width of the outside face of the curtain 1, parallel to the axis of the shaft 2 and rests against a rigid crossbar 42 also extending parallel to the axis of the shaft 2 when the curtain is in the closed position. This crossbar 42 is mounted on the fixed part of the device, such as the guide rails 5.

The distance traveled by the curtain from the crossbar 42 to its closed position must thus correspond to the distance between the added thickness 41 and the edge 8 of the curtain 1. In this respect, the position of the crossbar 42 as well as the added thickness 41 may be adjusted.

This allows any slack that may be present to remain in the part of the curtain 1 upstream from this added thickness 41. This solution is especially important for devices which do not have guide rails for the side edges of the curtain 1 or for which it is not possible to provide ballasting of the lower edge of the curtain opposite that of the shaft 2 side. This is the case, for example, when the curtain travels horizontally and whose side edges are not guided, as shown in FIGS. 18 to 20.

FIG. 21 concerns a feature that may be adapted on practically all embodiments described above, but which is especially useful for relatively long curtains and/or which travel with relatively significant friction in guide rails. This may be the case in the embodiment shown in FIGS. 18 to 20.

This feature consists in providing an opening 43 in the guide rails 5, near the drive wheel for example, between the open position and closed position of the curtain, in which the control element 11 can penetrate during its movement in the guide rail 5 at the moment when an obstruction occurs in the guide rail beyond this opening 43 considering the direction of travel of the control element 11.

In such a case, the part 11' of the control element 11 passing through this opening 43 actuates a detector 44 which sends a signal to a control station, not shown. This control station may possibly actuate a mechanism to correct the problem.

In the previous embodiments, the control element and the side edges of the curtain travel in the same guide rail. It is, however, possible to provide a guide rail, or other separate means, to guide the control element that is entirely independent of the guide rails for the side edges of the curtain and which allows, for example, the control element to move in a rectilinear path to or from the drive wheel.

In the curtain devices according to the invention, described above, a drive wheel 7, which is secured to the shaft 2, is provided on each side of the curtain. In this manner, the movement of the corresponding control elements is entirely synchronized.

Preferably, the curtain 1 is made of a material that allows the successive coils of the wound curtain to slide on one another, such that the curtain is, for example, made of a smooth and continuous material, such as a tarp or possibly polished plastic material for example.

When the control element is formed by a lance or an incompressible strap which is not looped, as in the embodiments described above, except for the third embodiment, this control element interacts with the curtain only to move it toward its closed position, the opening being performed by the rotation of the shaft 2 around its axis 6 in the direction opposite that used for closing.

It is also recommended to select the length of the curtain slightly longer than the height of the opening such that a slight amount of slack is present around the shaft 2 equally in the closed position. This allows for compensation of variations in the dimensions of the device and the opening, as well as to account for temperature variations that may have an effect on the length of the curtain.

Finally, in certain cases, the pin provided at the edge of the curtain opposite that of the shaft side may be removable, by means of a lever for example, to allow for easier installation and assembly of the device and also to facilitate the reintroduction of this pin into the guide rails following a disengagement of the contract from the latter, especially when the edge of the curtain opposite that of the shaft 2 side features a rigid bar, as in the seventh embodiment.

Although the curtain devices described above are equipped with guide rails, it is clear that the presence of these guide rails is not essential for the invention.

Of course, the invention is not limited to the various embodiments described above, and other variants may be considered without deviating from the scope of the invention.

For devices of reduced size, the curtain and the drive wheels may be actuated manually, for example, by means of a lever mounted on the curtain's wrapping drive.

In certain cases, if the curtain is made of a sufficiently heavy material, ballasting may be omitted.

In the seventh embodiment, the rigid bar of the edge 8 may be replaced by two studs at each of the ends of this edge which engage in the guide rails.

Furthermore, in each of the embodiments described above, means are advantageously provided enabling a maximum of one coil of the control element around the drive wheel parallel to the plane perpendicular to the axis of the shaft 2, such that the pitch diameter of the drive wheel remains more or less constant. In this manner, the control element will always travel at the same speed during curtain closing and opening operations. The aforementioned means are those that prevent the control element from winding onto itself around the drive wheel.

The invention claimed is:

1. A curtain device mounted on a shaft (2) around which the curtain (1) may be wound toward an open position and from which it can be unwound toward a closed position, a drive wheel (7) secured coaxially on the shaft (2) and cooperating with the curtain (1) in such a manner so as to move the latter between these two positions, wherein the device comprises a flexible oblong control element (11) that cooperates with the drive wheel (7), said control element (11) being mounted freely in relation to the curtain in such a manner to allow the curtain (1) to be moved between an open position and a closed position independently of slack which may form in the curtain (1), on the one hand, and to be able to move along at least one of the side edges (4) of the curtain (1) and act on the zone (8) of the latter opposite that mounted on the shaft (2), on the other hand, wherein the pitch diameter of the drive wheel (7) is less than the diameter of the wound portion of the curtain (1) in its open position, and is greater than the diameter of the aforementioned shaft (2) or the wound portion of the curtain (1) in its closed position.

2. The device according to claim 1, wherein the pitch diameter of the drive wheel (7) is greater than or equal to half the sum of the diameter of the wound portion of the curtain (1) in its open position, and of the diameter of the aforementioned shaft (2) or the wound portion of the curtain (1) in its closed position.

3. The device according to claim 1, further comprising means provided to enable a maximum of one coil of the control element (11) to be wound around the drive wheel (7) parallel to a plane perpendicular to the axis (6) of the shaft (2).

4. The device according to claim 1, wherein the control element (11) is incompressible in terms of its length.

5. The device according to claim 1, wherein the control element (11) is such that it can exert a pushing force on the curtain (1) to bring it to its closed position.

6. The device according to claim 1, wherein the control element (11) comprises an incompressible element in terms of its length.

7. The device according to claim 1, wherein the drive wheel (7) features a series of bosses or indentations (9) cooperating with the control element (11) and evenly spaced in relation to one another along the periphery of a circle, the center of which is located on the axis (6) of the foresaid wheel (7).

8. The device according to claim 7, wherein the control element (11) includes an endless tape or chain.

9. The device according to claim 1, further comprising means are provided for the curtain (1) to avoid slack from forming in the latter when it is being unwound.

10. The device according to claim 9, wherein said means to avoid slack include ballasting (22) at the edge of the curtain (1) opposite to that mounted on the aforesaid shaft (2).

11. The device according to claim 1, wherein the drive wheel is secured coaxially on the shaft (2) in such a manner to be able to travel at the same angular speed as this shaft (2).

12. The device according to claim 1, further comprising guide rails (5) in which the side edges (4) of the curtain (1) and the control element (11) can travel parallel to one another.

13. A curtain device mounted on a shaft (2) around which the curtain (1) may be wound toward an open position and from which it can be unwound toward a closed position, a drive wheel (7) secured coaxially on the shaft (2) and cooperating with the curtain (1) in such a manner so as to move the latter between these two positions, wherein the device comprises a flexible oblong control element (11) that cooperates with the drive wheel (7), said control element (11) being mounted freely in relation to the curtain in such a manner to allow the curtain (1) to be moved between its open position and its closed position independently of the slack which may form in the curtain (1), on the one hand, and to be able to move along at least one of the side edges (4) of the curtain (1) and act on the zone (8) of the latter opposite that mounted on the shaft (2), on the other hand, wherein the drive wheel (7) is such that the control element (11) can be wound spirally on it around its axis of rotation.

14. The device according to claim 13, wherein the drive wheel (7) has a truncated conical form such that, during both unwinding and winding of the control element, the linear speed of the latter essentially corresponds to that of the curtain (1) traveling between its open position and its closed position.

15. The device according to claim 1, further comprising a compensator is mounted on the aforementioned shaft (2) enabling the wound portion of the curtain (1) to be adapted to the travel of the control element (11).

* * * * *